US006634952B2

(12) United States Patent
Kroon et al.

(10) Patent No.: US 6,634,952 B2
(45) Date of Patent: Oct. 21, 2003

(54) FERRIS WHEEL

(75) Inventors: Louisito Johannes Eusebio Kroon, Neede (NL); Albert Louisito Phillipus Kroon, Neede (NL)

(73) Assignee: Cobra Beheer B.V., Neede (NL)

( * ) Notice: Subject to any disclaimer, the term of this patent is extended or adjusted under 35 U.S.C. 154(b) by 0 days.

(21) Appl. No.: 10/082,070

(22) Filed: Feb. 26, 2002

(65) Prior Publication Data

US 2003/0162596 A1 Aug. 28, 2003

(51) Int. Cl.[7] ..... A63G 1/08
(52) U.S. Cl. ..... 472/3; 472/44; 472/30
(58) Field of Search ..... 472/3, 44, 45, 472/29, 38; 280/413

(56) References Cited

U.S. PATENT DOCUMENTS 2,590,934 A * 4/1952 Catlett ..... 472/3
2,847,216 A * 8/1958 Courtney ..... 472/3
3,456,943 A * 7/1969 Brown ..... 248/421
4,988,089 A * 1/1991 Knijpstra ..... 472/3
5,688,178 A * 11/1997 Emrie ..... 438/654

* cited by examiner

*Primary Examiner*—Kien T. Nguyen
(74) *Attorney, Agent, or Firm*—Young & Thompson

(57) ABSTRACT

A ferris wheel has a base, a supporting structure, which includes two pairs of masts erected on the base, and at their top end bear a head and a wheel that is rotatably supported on the head. The masts can be folded down on the base. At least one mast of each pair of masts is articulated, in such a way that in the erected state of the supporting structure the articulations of a mast are aligned in each case, and in the folded-down state of the supporting structure the articulations of a mast are in each case rotated relative to each other out of the aligned state.

10 Claims, 6 Drawing Sheets

FERRIS WHEEL

The invention relates to a Ferris wheel, comprising base means, a supporting structure consisting of two pairs of nets, which are erected on the base means and at their top end bear a head, and also a wheel that is rotatably supported on the head, which masts can be folded down on the base means.

Such a Ferris wheel is known from EP-A-389008. One mast of each pair of masts is hingedly connected to the top side of a container. The other mast of each pair is movably supported on the container. This means that the masts can be folded down into the container. The components of the Ferris wheel can then be transported in the containers.

The disadvantage of this Ferris wheel is that its height is limited by the dimensions of the container, Since the masts have to fit into the container, they cannot be selected in a length that is greater than the internal length measurement of the container.

The object of the invention is to disclose a Ferris wheel of the abovementioned type which does not have this limitation. That object is achieved by the fact that at least one mast of each pair of masts is articulated, in such a way that in the erected state of the supporting structure the articulations of a mast are aligned in each case, and in the folded-down state of the supporting structure the articulations of a mast are in each case rotated relative to each other out of the aligned state about axes of rotation that are essentially parallel to the axis of rotation about which the wheel is rotatably supported on the head.

The articulated design of the supporting structure makes it possible to use relatively long masts, which can still be folded down to relatively small dimensions. This makes it possible to use a fairly tall Ferris wheel, which is still transportable, in view of the limited dimensions when it is folded down.

According to a special embodiment, one mast of each pair of masts can have a mast part that is rotatably connected to the base means, and the other mast can have a mast part that is immovably connected to the base means. The mast part that is rotatably connected to the base means is approximately the same length as the other mast part belonging to the same mast, while the mast part that is immovably connected to the base means is shorter in length than the other mast part belonging to the same mast.

Furthermore, the head from which the wheel is rotatably suspended can be rigidly connected to one of the masts. The head in this case is hingedly connected to the other mast.

For purposes of the transportability of the Ferris wheel, each pair of masts is accommodated on its own separate base. In particular, each pair of masts can be accommodated on its own separate mobile undercarriage such as a trailer.

In that case the head comprises two head halves which are detachably connected to each other, each head half being connected to a pair of masts. For the assembly of the Ferris wheel, the trailers are disposed side by side parallel to each other and stabilized in the correct way. The head halves can then be connected to each other, after which the masts can be erected, which means that the supporting structure is ready, and the wheel can be suspended from it.

The invention will be explained in greater detail below with reference to an exemplary embodiment of a Ferris wheel according to the invention illustrated in the figures.

FIGS. 11*a* to 11*e* show the steps of attaching a spoke to the ring irons.

Figure 1:
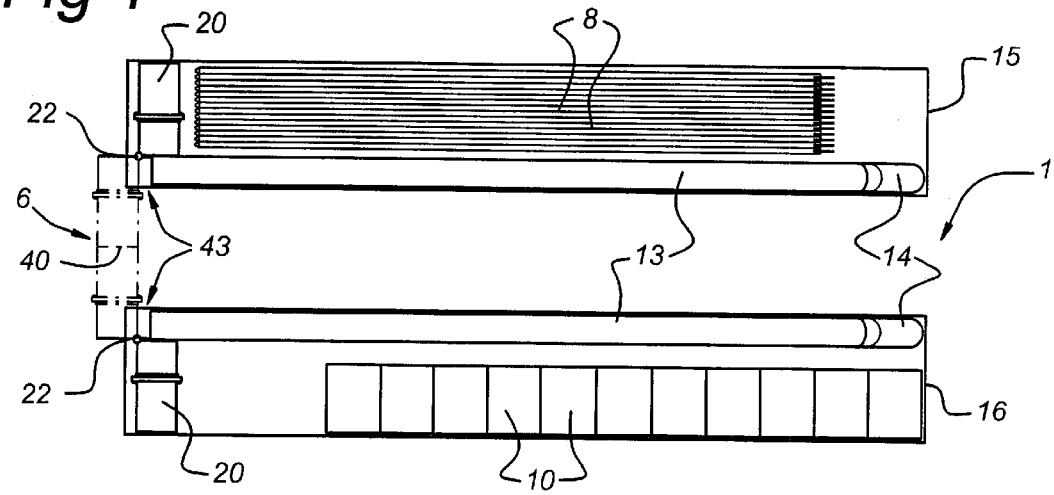
FIG. 1 shows a top view of two trailers, each with a pair of masts in the folded-down state.
Figure 12:
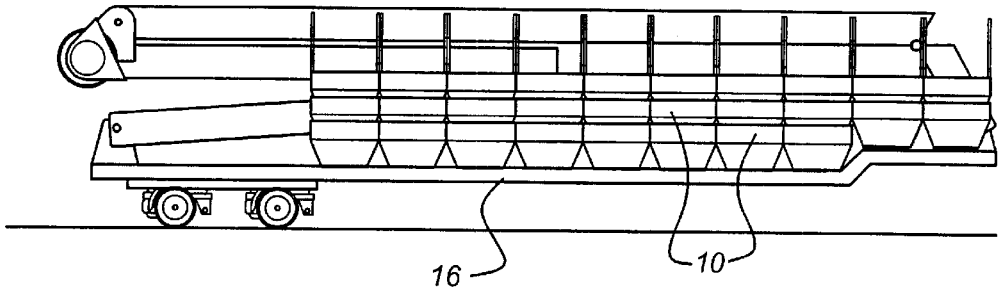

FIG. 12 shows a side view of a trailer according to FIG. 1 with folded-in arm and gondolas.

Figure 13:
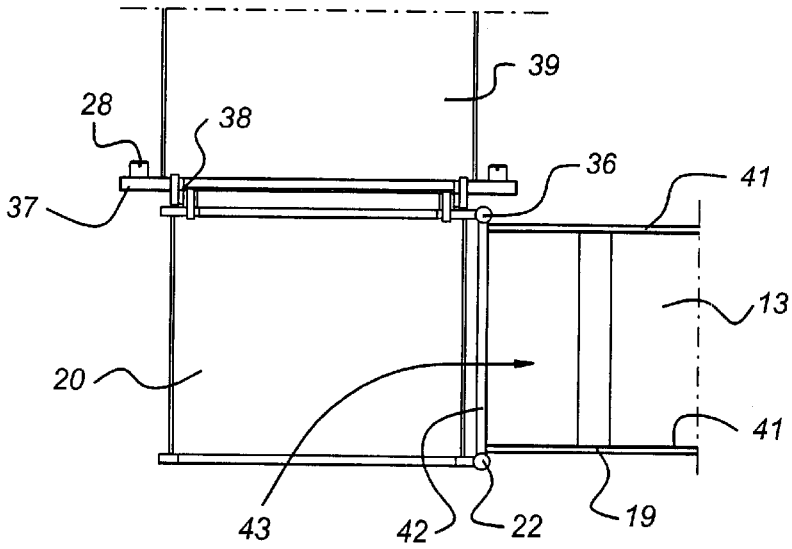

FIG. 13 shows a detail of the head.

Figure 14:
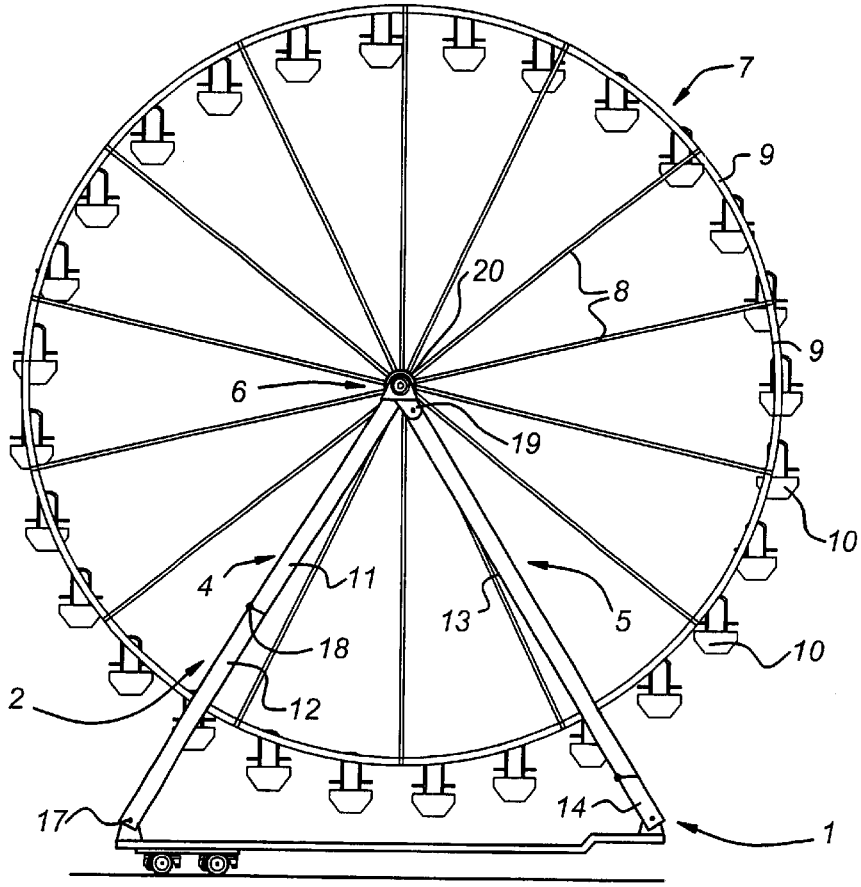

FIG. 14 shows the completed Ferris wheel.

The completed Ferris wheel shown in FIG. 14 comprises a base 1, which has on it a supporting structure 2 composed of two pairs of masts 4, 5, one pair of which is visible. These masts bear on their top end a head 6, on which the wheel, indicated in its entirety by 7, is rotatably supported.

The wheel comprises a number of spokes 8, which at their outermost ends are each connected by ring irons 9, from which the gondolas 10 are suspended.

Each pair of masts 4, 5 consists of two articulated parts 11, 12 and 13, 14 respectively, the raising of which will be explained below with reference to FIG. 1 and the following figures.

FIG. 1 shows a top view of the base means 1, which base means 1, are composed of two trailers 15, 16. In the example of FIG. 1 a pair of masts 4, 5 is shown in the folded-up position on each of these trailers, as can also be seen clearly in FIG. 2. Furthermore, the spokes 8 are accommodated on the one trailer 15, while the gondolas 10 are accommodated on the other trailer 16.

Figure 2:
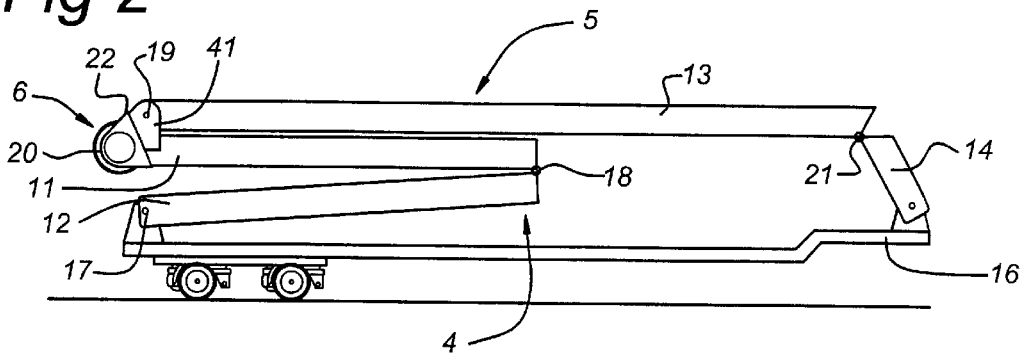
FIG. 2 shows a side view of one of the trailers with the masts in the folded-down state.

Trailer 16 is illustrated in FIG. 2, but for the sake of clarity the gondolas 10 are not shown. The mast parts 11, 12 of the one mast 4 are folded down about the hinges 17, 18 and 19. The hinge 17 forms the connection between the bottom mast part and the trailer 16, the hinge 18 forms the connection between the two mast parts 11, 12, and the hinge 19 forms the connection between the head 6 and the mast part 13 of the other mast 5. The head 6 is therefore rigidly connected to the top mast part 11 of the mast 4. In turn, the mast part 13 of mast 5 is connected by way of a hinge 21 to the bottom mast part 14 thereof, which bottom mast part 14 is in turn rigidly connected to the trailer 16. If desired, this bottom mast part 14 can also be dispensed with or replaced by a raised construction of the trailer 16.

Figure 8:
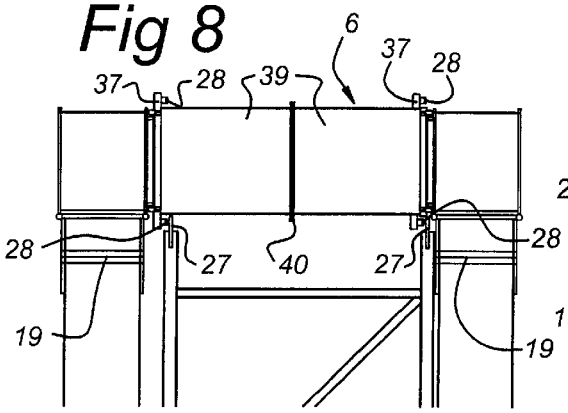
FIGS. 8 and 9 show the attachment of a spoke to the supporting structure.
Figure 9:
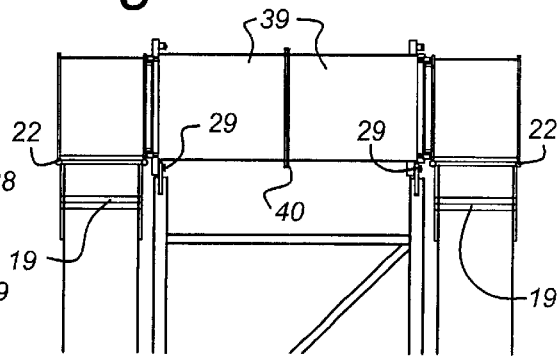

Before the masts 4, 5 are raised, the head 6 is assembled by connecting the two head parts 20 of the pairs of masts to each other. As shown in FIG. 1, these head parts 20 are initially folded outwards, As likewise shown by the dashed-line mid-positions in FIG. 1, these head parts 20 are subsequently swung inwards about their hinges 22 and are then attached to each other at their ends facing each other and locked, as will also be explained below with reference to FIGS. 8, 9 and 13.

The head parts are hingedly fixed to a cap 43, consisting of flanges 41 and a cross bulkhead 42. The cap 43 is in turn rotatably connected by means of hinge 19 to mast part 17 of mast 5.

Figure 3:
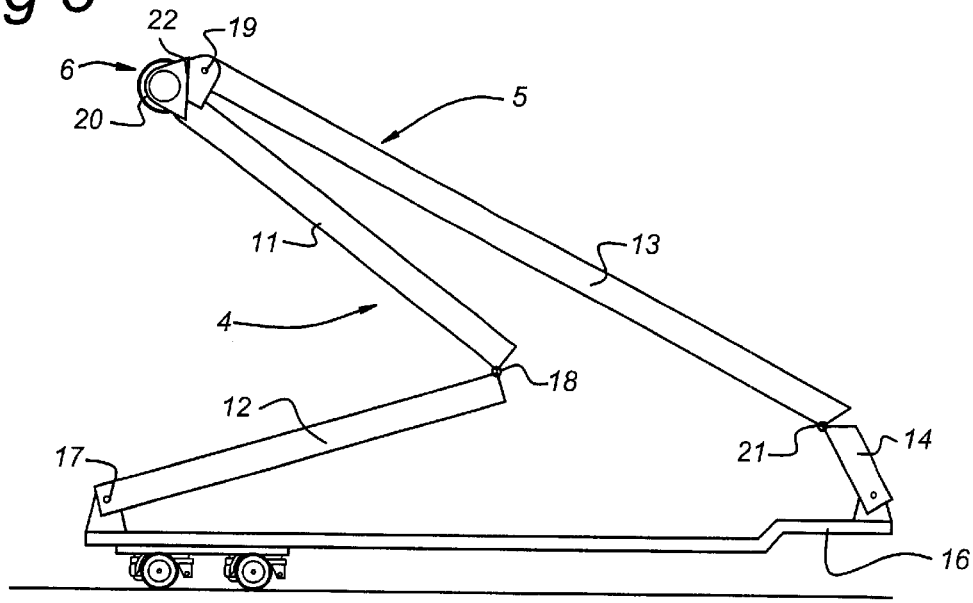
FIGS. 3 and 4 show two stages in the upward movement of the masts.
Figure 4:
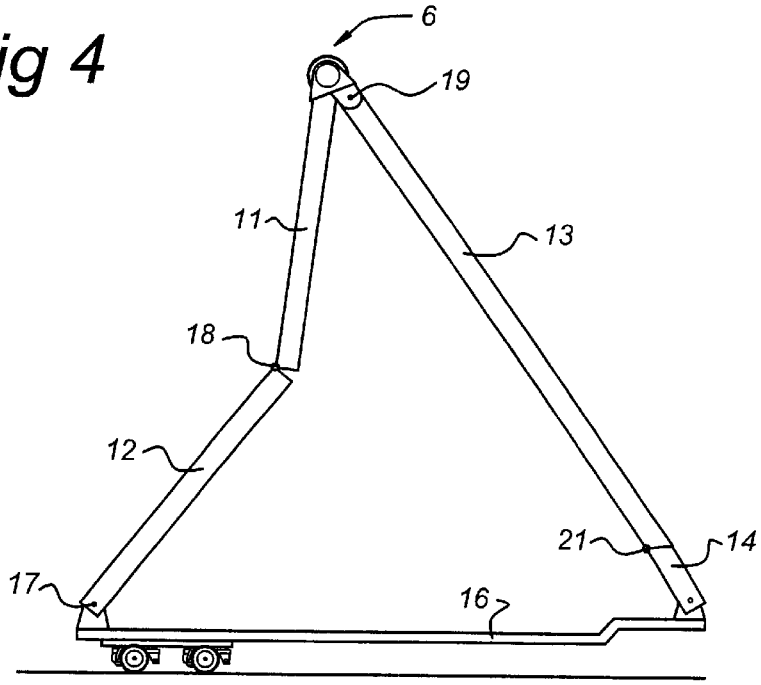
Figure 5:
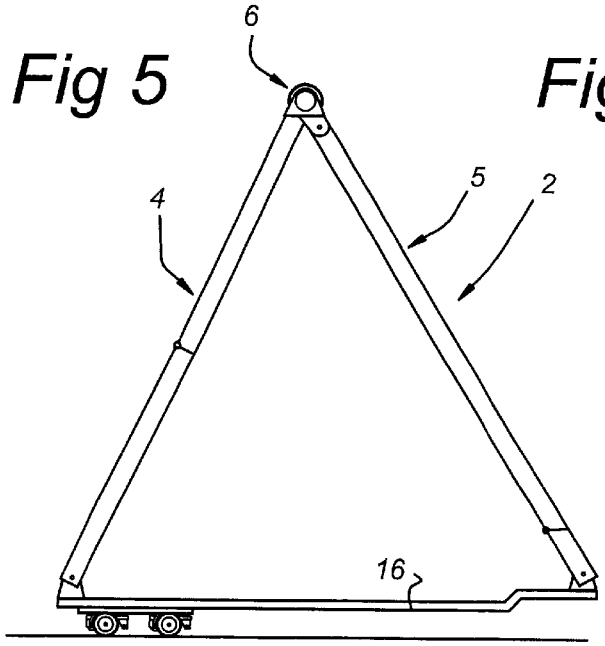
FIG. 5 shows a side view of the supporting structure with masts fully raised.
Figure 6:
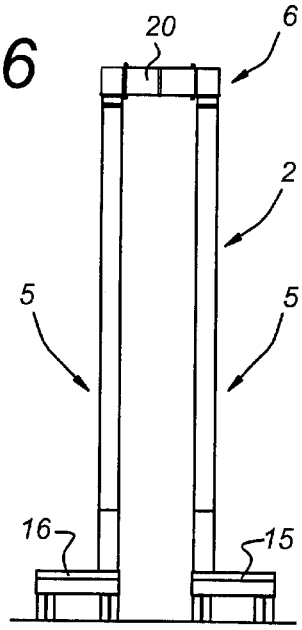
FIG. 6 shows a front view of the supporting structure with the corresponding two trailers.
Figure 7:
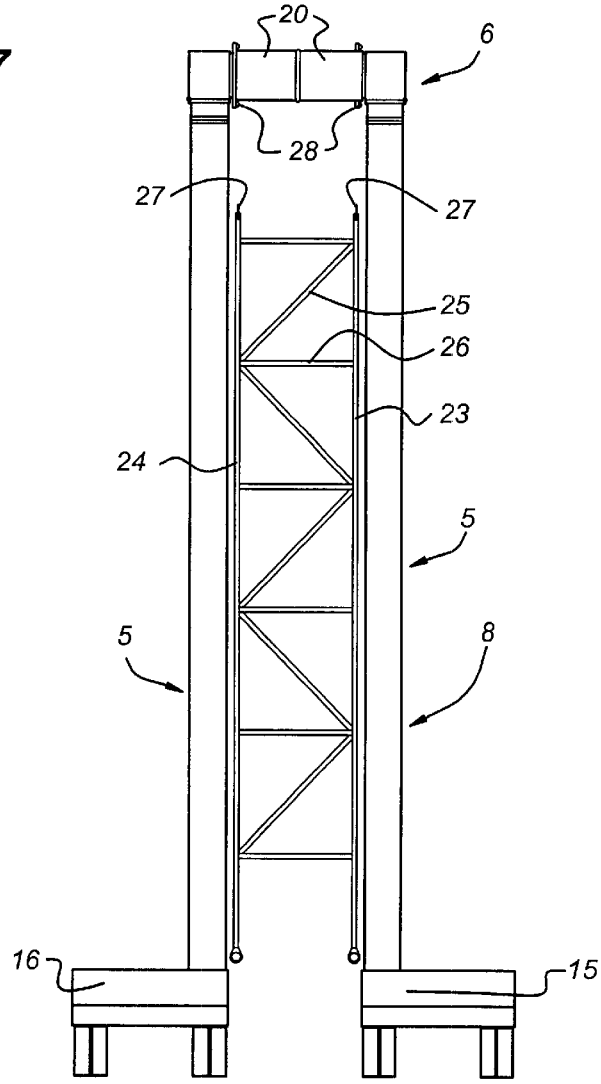
FIG. 7 shows the stage of fitting a spoke on the supporting structure.

The two pairs of masts 4, 5 are then raised, as shown in FIGS. 3 and 4, until they are in the fully extended position shown in FIGS. 5 and 6, in which the supporting structure 2 is ready, The spokes are then suspended from the head 6. Each spoke 8 comprises two bars 23, 24, which are connected to each other by a framework of slanting bars 25 and transverse bars 26. On their racially innermost end the bars 23, 24 have eyes 27, which are hooked behind the shaft ends 28 of the head 6 (see FIGS. 8 and 9). The eyes 27 are then locked on the shaft ends 28 by a locking means 29, for example a pin that is inserted into a corresponding hole in the shaft end 28.

Figure 10:
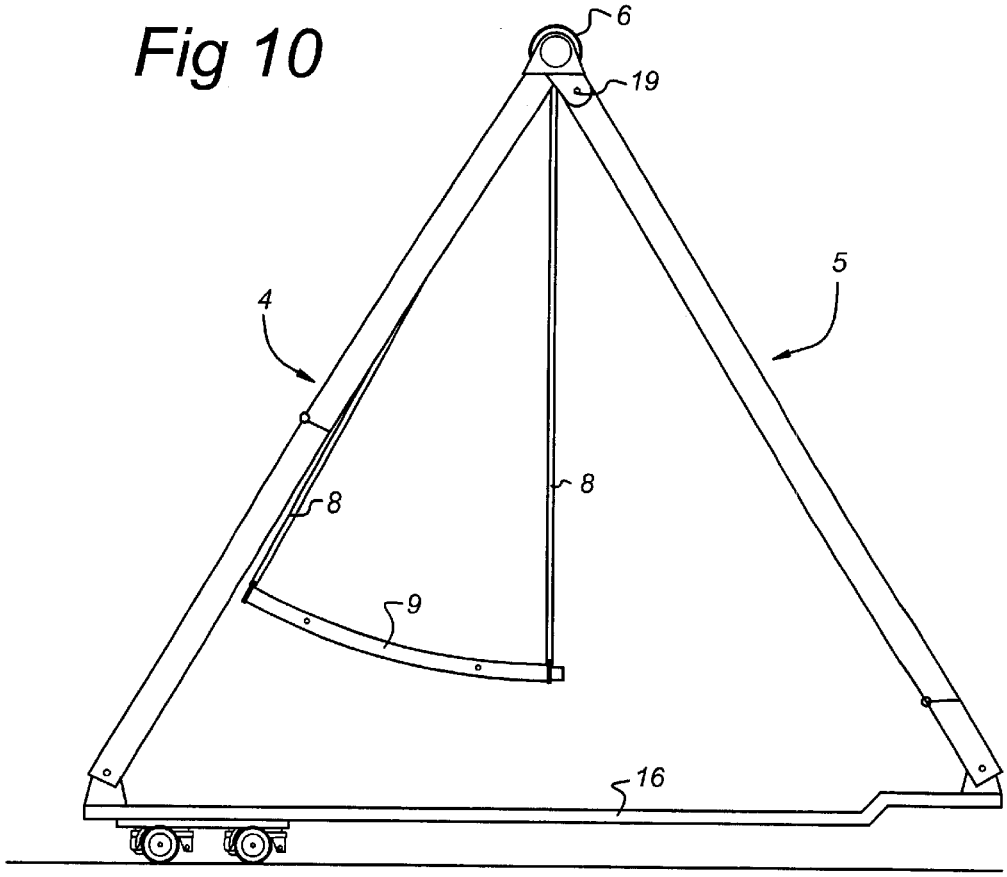
FIG. 10 shows the stage of fitting a second spoke with ring iron.
Figure 11A:
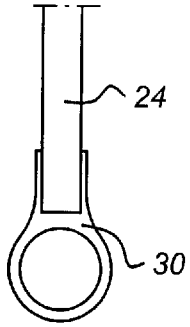
Figure 11B:
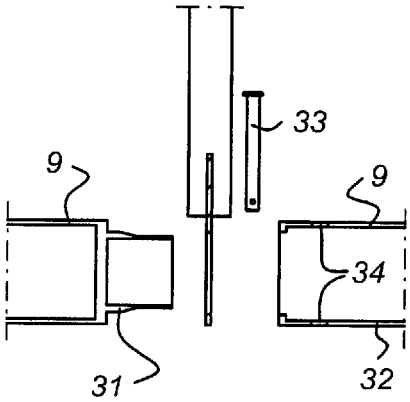
Figure 11C:
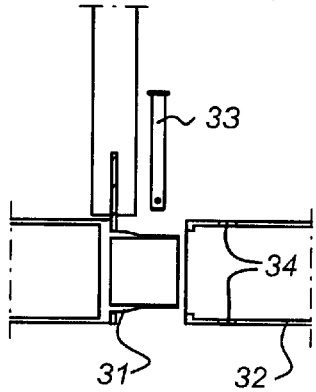
Figure 11D:
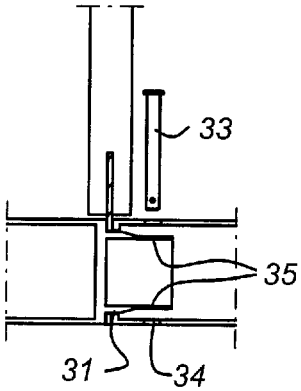
Figure 11E:
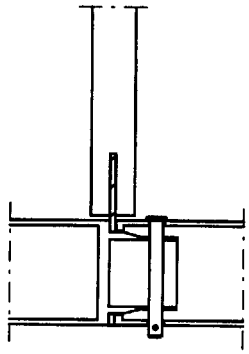

As shown in FIG. 10, a second spoke 8 can then be suspended from the head, after which a ring iron 9 is fitted between the two spokes 8. As shown in FIGS. 11*a* to 11*e*, each bar 23, 24 has an eye 30 for this purpose, said eye being slid along a corresponding shaft end 31 to the end of a corresponding ring iron 9 (see FIGS. 11*b* and 11*c*). The ring irons 9 have on their other end a hole 32, into which said shaft end 31 can subsequently be inserted. As shown in FIG. 11*d*, the eye 30 in this case is securely retained between the two adjacent ring irons 9. In order to lock this connection, a locking pin is subsequently inserted through the holes 34 of the last ring iron, and the holes 35 in the shaft end 31 of the other ring iron, after which the locked position shown in FIG. 11*e* is obtained.

In this way all spokes 8 and ring irons can be assembled to form the wheel 7, as shown in FIG. 14. Finally, the gondolas can be suspended from the wheel 7 formed in this way.

As shown in FIG. 12, the entire Ferris wheel can be transported efficiently on two trailers 15, 16. The gondolas 10 are stacked next to and on top of each other beside the folded-down masts on the trailer 16; as can be seen in FIG. 1, the spokes 8 are stacked on the other trailer 15.

In the detail of FIG. 13, it can be seen that the head parts 20 in their position folded towards each other about hinge 22 can be locked by means of the lock 36. It can also be seen in FIG. 13 that the shaft ends 28 are accommodated on a ring 37, which in turn is supported by means of a bearing 38 on the drum 39 of the head part 20. As can also be seen in FIGS. 8 and 9, these drums 39 are securely fastened to each other by means of a flange connection 40.

What is claimed is:

1. In a ferris wheel comprising base means (1), a supporting structure (2) consisting of two pairs of masts (4, 5), which are erected on the base means (1) and at their top end bear a head (6), and also a wheel (7) that is rotatably supported on the head (6), wherein said two pairs of masts (4, 5) can be folded down on the base means (1); the improvement wherein at least one mast of each pair of masts (4, 5) is articulated, in such a way that in the erected state of the supporting structure (2) the articulations (11–14) of each of said masts (4, 5) are aligned and in the folded-down state of the supporting structure the articulations of each of said masts (4, 5) are both rotated relative to the base means out of the aligned state.

2. Ferris wheel according to claim 1, wherein the articulations of at least one of said masts comprise axes of rotation that are essentially parallel to the axis of rotation about which the wheel (7) is rotatably supported on the head (6).

3. Ferris wheel according to claim 1, in which each of said masts (4, 5) comprises two articulated mast parts (11–14).

4. Ferris wheel according to claim 1, in which one mast of each pair of masts (4, 5) has a mast part (11) that is rotatably connected to the base means (1), and the other mast (5) has a mast part (14) that is immovably connected to the base means (1).

5. Ferris wheel according to claim 1, in which each pair of masts (4, 5) is accommodated on its own separate base (15, 16).

6. Ferris wheel according to claim 5, in which the head (6) comprises two head halves (20), and each head half (20) is connected to a pair of said masts (4, 5), said head halves (20) being detachably connected to each other.

7. Ferris wheel according to claim 6, in which the head halves (20) can be swung about an axis (22) which extends crosswise to the axis of rotation of the wheel (7).

8. Ferris wheel according to claim 7, in which each head half (20) is hingedly fixed to a cap (43), which cap (43) is rotatably fixed to one of the masts (4, 5).

9. Ferris wheel according to claim 1, in which each pair of masts (4, 5) is accommodated on its own separate mobile undercarriage such (15, 16).

10. In a ferris wheel comprising a base and masts articulately connected to the base for movement between a lowered position and a raised position, said masts in said raised position comprising two sides of a triangle of which the base comprises a third side, the masts carrying a head and a wheel that is rotatably supported on the head at an apex of said triangle when said masts are in said raised position; the improvement wherein at least one of said masts is comprised by a plurality of sections that are articulately interconnected with each other and with said base and which lie one on top of the other in said lowered position.

* * * * *